United States Patent [19]

Culver et al.

[11] Patent Number: 4,473,321

[45] Date of Patent: Sep. 25, 1984

[54] METHOD OF LAUNCHING A LARGE FLOATABLE OBJECT FROM A DOCK TO WATER AND DELAUNCHING IT

[75] Inventors: David W. Culver, Oak Lawn; Frederick J. Thielbar, Wheaton, both of Ill.

[73] Assignee: Chicago Bridge & Iron Company, Plainfield, Ill.

[21] Appl. No.: 490,856

[22] Filed: May 2, 1983

[51] Int. Cl.[3] ..... B63C 3/00

[52] U.S. Cl. ..... 405/3; 114/49; 114/44; 405/206

[58] Field of Search ..... 114/49, 44, 52, 53, 114/266, 265, 267, 262; 405/1, 2, 3, 203, 205, 206, 209

[56] References Cited

U.S. PATENT DOCUMENTS

| | | | |
|---|---|---|---|
| 3,358,884 | 12/1967 | Link | 114/44 |
| 3,478,526 | 11/1969 | Foster | 405/2 |
| 3,845,634 | 11/1974 | Rosenberg et al. | 405/209 |
| 4,165,196 | 8/1979 | Serrano | 405/209 |

*Primary Examiner*—Sherman D. Basinger
*Assistant Examiner*—C. T. Bartz
*Attorney, Agent, or Firm*—Marshall, O'Toole Gerstein, Murray & Bicknell

[57] ABSTRACT

A method of launching a large object such as a ship, barge or floatable offshore structure from a dock to water at a lower level than the dock surface by pushing the object over the dock edge, supporting the portion of the object extending past the dock edge on open bottom launch cans and continuing the procedure until the object is fully supported above the water only by the launch cans. By ballasting the launch cans the object is lowered into the water where it floats.

11 Claims, 24 Drawing Figures

METHOD OF LAUNCHING A LARGE FLOATABLE OBJECT FROM A DOCK TO WATER AND DELAUNCHING IT

This invention relates to launching and delaunching of ships, barges and offshore structures. More particularly, this invention is concerned with methods and apparatus for launching a nonhoistable ship, barge or offshore structure from a dock or dockyard above sea level, without sliding it down an inclinded plane into the water, by pushing it into load supporting position on launch cans and then ballasting the cans to float the ship, barge or structure on the water. The invention is also concerned with delaunching a floating ship, barge or offshore structure by reversing the launching procedure.

BACKGROUND OF THE INVENTION

Ships and barges are usually built on land and then launched by sliding them down an inclined plane longitudinally or sideways. Other structures are not readily launched in this way because of their size and shape so they are largely built in water to make launching unnecessary. Some of the large concrete offshore structures used in North Sea oil exploration and production are of this type. However, it is usually less expensive and faster to build vessels and offshore structures wholly on land than to build them partially or wholly on water.

An alternative approach is to construct a graving dock, build the ship, barge or other structure within the graving dock and then flood the graving dock to float the vessel, barge or structure. Removal or opening of the dike or gate to the sea permits movement of the vessel or structure out to sea. While this approach is practical it is often very expensive, largely because of the cost of constructing the graving dock and its dike or gate.

There are many areas on docks or dockyards where large size nonhoistable ships, barges and floatable offshore structures can be built. However, the dock surfaces are generally 5 to 30 feet above the sea or water level so that it is not possible to simply push them over the dock edge to launch them into the water. Similarly, delaunching a ship, barge or floating structure from water onto a dock is not readily accomplished when they are too big to hoist onto the dock. A need accordingly exists for apparatus and methods of launching and delaunching ships, barges and floatable offshore structures from and to such docks.

SUMMARY OF THE INVENTION

According to one aspect of the invention there is provided a method of launching a large floatable object over a dock edge from a dock surface higher than the adjacent water surface comprising positioning the large floatable object on substantially horizontal slide ways on the dock surface; moving the floatable object along the ways until an end portion thereof extends past the dock edge and above the water; moving at least one floating launch can having a closed top surface, a vertical wall attached to the top surrounding a space and a bottom open to the water, beneath that part of the floatable object extending past the dock edge and above the water; pumping a gas into the launch can to increase its buoyancy and place the can top in load supporting arrangement with the bottom of the floatable object; moving the floatable object further along the slide ways so as to extend more of the floatable object past the dock edge and above the water; moving one or more additional launch cans of the described type beneath that part of the floatable object extending unsupported past the dock edge and above the water, and then pumping a gas into the launch cans to increase their buoyancy so as to place the cans in load supporting arrangement with the bottom of the floatable object; repeating the described steps of moving the floatable object further along the slide ways so as to extend more of it past the dock edge and over the water, positioning additional launch cans of the described type beneath the floatable object, and pumping gas in the cans to increase their buoyancy and place the launch cans in load supporting arrangement until the floatable object is off the dock and stably and entirely floating on launch cans; and removing gas from the launch cans to decrease their buoyancy at least sufficiently for the floatable object to be lowered to float in the water without support by the cans.

Additional gas can be supplied to the launch cans as may be necessary to have them support the added load while maintaining the floatable object level as it extends further and further past the dock edge and over the water.

The method is especially useful when the bottom of the floatable object is flat and the tops of the launch cans are flat.

Each launch can may contain buoyancy means to stabilize the can in floating position with the top above water when no load is added to the can. The buoyancy means desirably includes a plurality of constant or hard volume closed chambers, such as in the form of closed buoyancy cans, equally spaced apart radially in fixed position along each launch can wall, with said launch can having a negative buoyancy when free flooded because the buoyancy provided by the buoyancy chambers is insufficient to float the launch can. The buoyancy means can also include a vertical cylindrical circular skirt open at the bottom and attached at the top to the lower surface of the launch can top thereby defining a space in which gas can be contained, means to remove virtually all gas from the space to fully sink the can in the water and means to supply gas to the space to raise the can in the water, said launch can being floatable when the skirt is about one-half full of gas.

The invention also includes the method of repositioning a floating object on a dock by reversing the order of the steps in the described process.

The method of positioning or delaunching a large floating object on a dock having a surface higher than the water level adjacent the dock comprises positioning a plurality of launch cans beneath the bottom of the floating object; said launch cans having a closed top surface, a vertical wall attached to the top surrounding a space and a bottom open to the water; pumping a gas into the launch cans to increase their buoyancy and place the can tops in load supporting arrangement of the bottom of the floatable object and continuing to pump gas into the launch cans until the bottom of the floating object is supported by the launch cans at or slightly above the height of the dock; moving the large object until one end portion extends onto the dock and rests on supporting ways; ballasting one or more launch cans adjacent the dock and removing them; moving the large object further onto the dock by sliding it on the supporting ways; ballasting one or more launch cans, adjacent the dock, while supporting the large object and then removing them; moving the large object further onto the dock by sliding it on the supporting ways; and repeating the described steps, if necessary, until the large object rests on the supporting ways on the dock unsupported by any launch cans.

All of the other aspects of the previously described launching procedure and equipment can be used in this delaunching method, generally by reversing the launching operation or sequence.

BRIEF DESCRIPTION OF THE DRAWINGS

With reference to FIGS. 1, 2 and 2A, the 5000 ton submersible offshore drilling rig 10 has a mat 12, a superstructure 14 and three columns 16, 17 and 18 extending upwardly from the mat to support the superstructure and provide stability to the rig. The drilling rig 10 is constructed on dock 20, which has a surface 22 located about six to ten feet above water level 24. In anticipation of launching the drilling rig from dock 20 over the dock edge 26 to the water, the mat 12 is fabricated initially on a plurality of parallel spaced apart slide ways 28 supported on the dock surface. Since the bottom of mat 12 is flat and planar the slide ways 28 are located so as to have their upper surfaces in a common horizontal plane. The slide ways 28 suitably include I-beams 30 located with their flanges horizontal (FIG. 16). A long metal plate 32 is placed on top of the I-beams 30. The top of plate 32 is covered with grease 34 on which hardwood planks 36 slide. Angles 38 are used to retain planks 36 on those plates 32 which do not operatively support the gripper-pusher jacks used to push the drilling rig as will be described subsequently.

Figure 1:
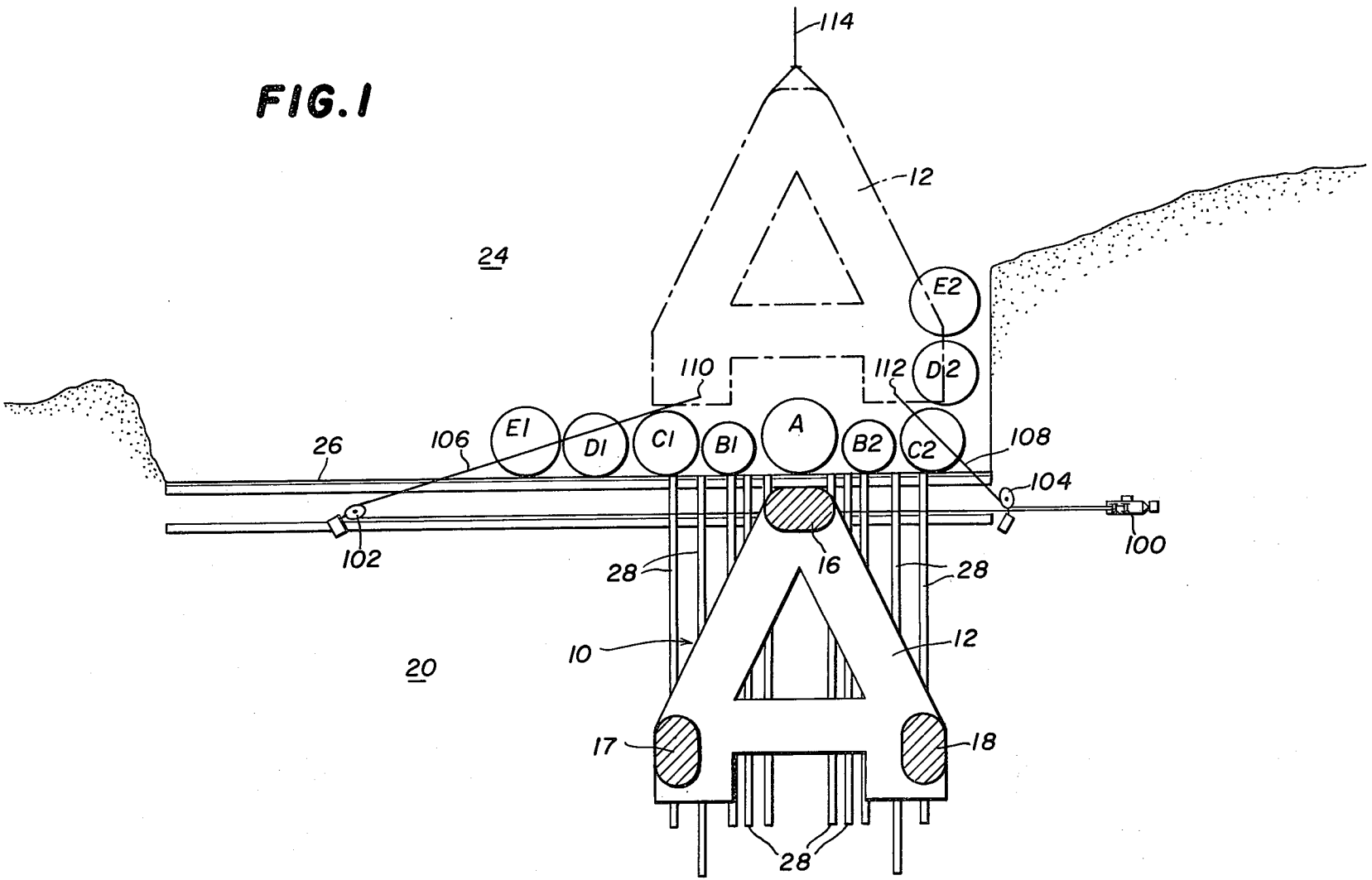
FIG. 1 is a plan view, partially in section and in phantom, illustrating an offshore semisubmersible drilling rig in prelaunch position on a dock adjacent water, the prelaunch position of all of the launch cans used in the launching and the rig after launching.

The drilling rig 10 illustrated by the drawings is used to drill oil and gas wells in comparatively shallow water. The mat 12 and columns 16, 17 and 18 are hollow and when empty the drilling rig floats with only a few feet of draft. The drilling rig is readily towed to a suitable drilling site. Then the mat 12 and columns 16, 17 and 18 are flooded with water until the mat rests on the sea floor with superstructure 14 safely above wave action. The drilling of wells is then started. Clearly, the drilling rig cannot be used as described until after it is launched to float on the water surface.

It is not practical to lift the drilling rig and place it in the water because it is very heavy, i.e. 5000 tons or more. Also, the drilling rig cannot be safely pushed unsupported over the dock edge 26 because the concentrated forces applied to the mat where it contacts the dock edge would cause the mat to fail, and perhaps the entire rig to collapse.

A group of nine launch cans 40 given letters A, B1, B2, C1, C2, D1, D2, E1 and E2 are used to launch the drilling rig. The launch cans are dimensioned according to their position of use in supporting the drilling rig and the calculated load they will bear. For the particular drilling rig illustrated by the drawings, launch cans B1 and B2 are radially sized the same; C1, C2, D1 and D2 are radially sized the same; and E1 and E2 are radially sized the same. Launch can A is radially larger than the other launch cans. All the launch cans have the same height. The launch cans may be desirably arranged as shown in FIG. 1 in preparation for launching the rig.

Figure 17:
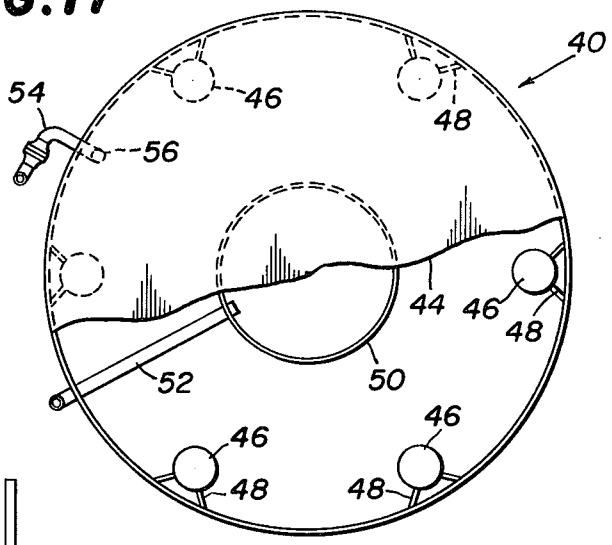
FIG. 17 is a top plan view, partially broken away, of a launch can.
Figure 18:
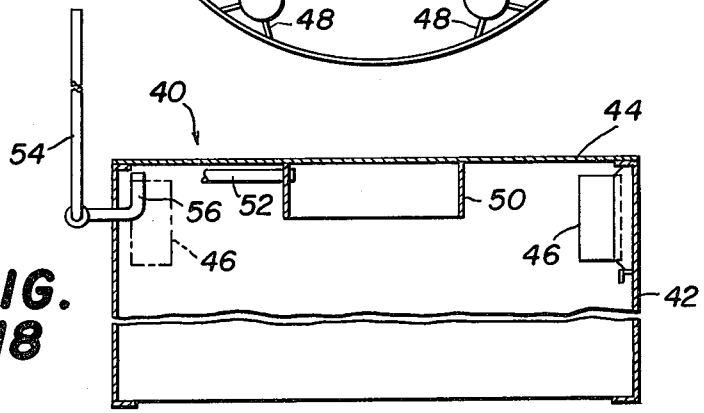
FIG. 18 is a vertical sectional view of the launch can shown in FIG. 17. cl DETAILED DESCRIPTION OF THE DRAWINGS To the extent it is reasonable and practical the same or similar elements or parts which appear in the various views of the drawings will be identified by the same numbers.
Figure 16:
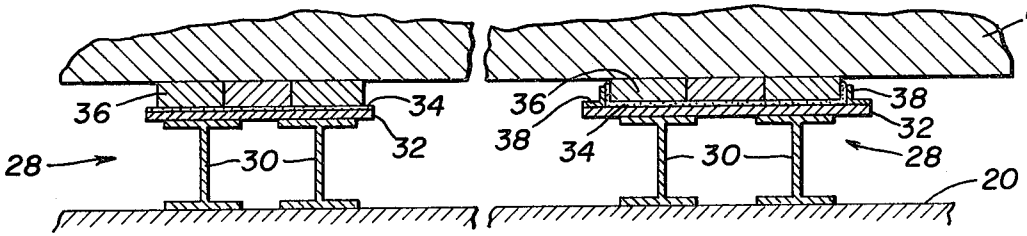
FIG. 16 is a sectional view taken along the line 16—16 of FIG. 11.
Figure 11:
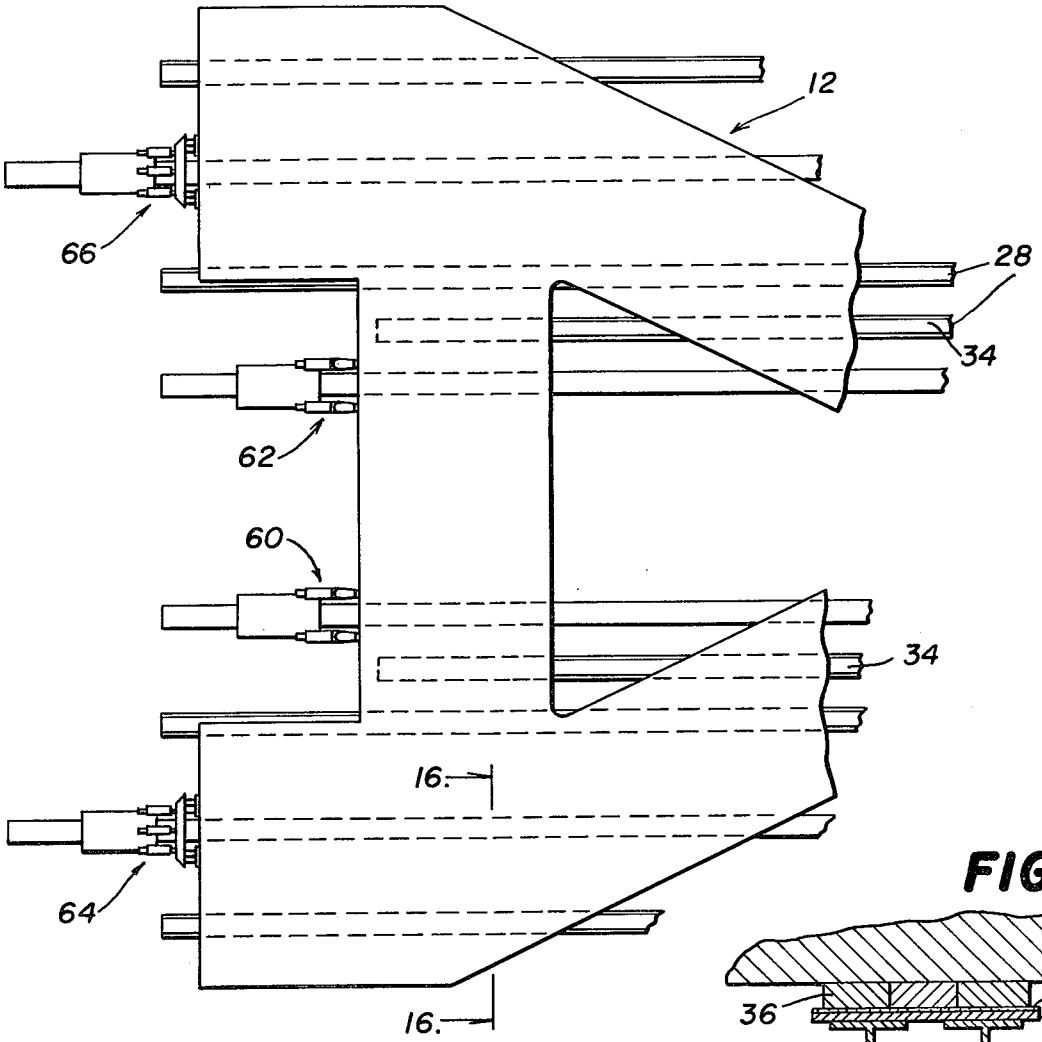
FIG. 11 is an enlarged partial plan view of the mat stern on the supporting slide ways showing the arrangement of the four gripper-pusher jacks.

FIGS. 17 and 18 illustrate the construction of all the launch cans 40. Each launch can 40 has a vertical circular cylindrical metal shell 42 and a flat top 44. Six fully enclosed and sealed buoyancy cans or chambers 46 containing air or some other gas are attached equally spaced apart to the upper inside surface of shell 42 by brackets 48. The buoyancy provided by the cans or chambers 46 is insufficient to float the launch can 40. The buoyancy cans or chambers 46, however, substantially reduce the negative buoyancy of the launch can 40 so that relatively little additional buoyancy must be supplied to float it. Also, the buoyancy cans 46 provide stability when the launch can is free floating.

Attached to and suspended from the inside surface of top 44 is an axially positioned circular cylindrical ring or skirt 50 (FIGS. 17 and 18). Conduit 52 extends through ring or skirt 50 and through shell 42 and provides a means for removing air from the space surrounded by ring 50. Conduit 52 also is used to supply air not only to ring 50 but also to the entire space, exclusive of the buoyancy cans or chambers 46, within launch can 40. A suitable valve not shown is included in conduit 52 outside of shell 40 to control flow of air to and from the shell interior.

Ring or skirt 50 is sized so that when it is about one-half full of air, and water fills launch can 40 up to the top 44, the launch can 40 will float and maintain a level top position. This is important when the launch can is beneath mat 12 because it permits removal of essentially all air through conduit 54 from the space in the launch can outside of ring 50. That part 56 of conduit 54 inside of shell 42 is directed upwardly to terminate close to but spaced downwardly from the lower inner surface of top 44 to facilitate such air removal. A valve not shown is included in conduit 54 outside of shell 42 to control desired flow of air from the space surrounded by the shell.

The drilling rig 10 is moved along slide ways 28 by an identical pair of double cylinder gripper jacks 60 and 62 and an identical pair of more powerful triple cylinder gripper jacks 64 and 66 (FIGS. 2 and 11 to 15). These gripper jacks are commercially available.

Figure 12:
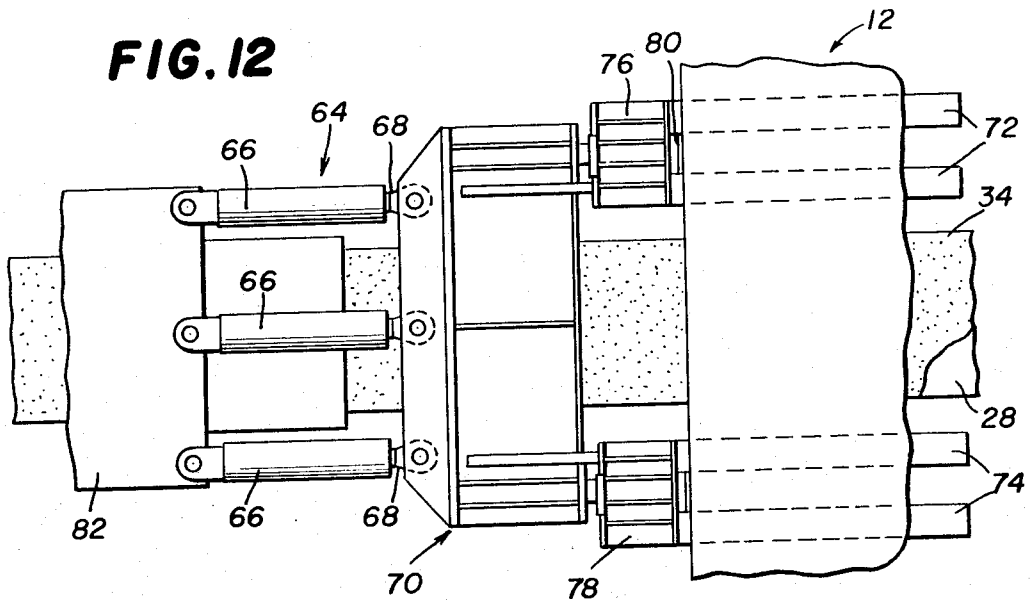
FIG. 12 is a plan view showing the arrangement of the larger gripper-pusher jacks used to apply pressure to the mat stern.
Figure 13:
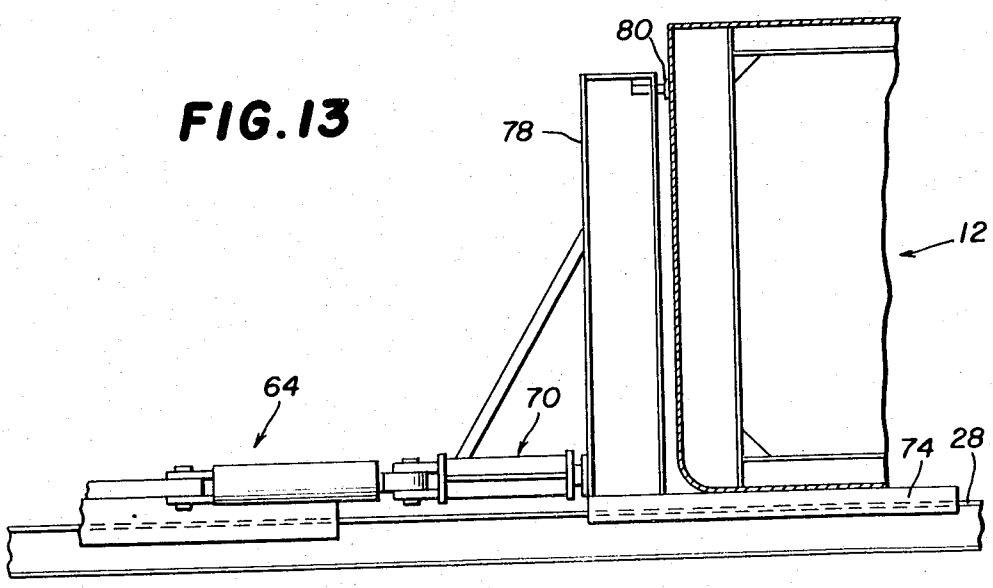
FIG. 13 is an elevational view of the arrangement shown in FIG. 12.

As shown in FIGS. 12 and 13, the gripper jack 64 has three double acting hydraulic cylinders 66. A piston rod 68 extends out of the front end of each cylinder 66 and is pivotally attached to beam 70. Two pair of legs 72 and 74 project forward from beam 70 into welded engagement with the bottom of mat 12. Extending upwardly from legs 72 and 74 are transom members 76 and 78. A pad 80 is placed between each transom member 76 and 78 and the adjacent vertical face of mat 12. The transom members serve to prevent the piston rods and beam 70 from rotating upwardly when the jack applies pushing pressure to the drilling rig 10.

The gripper jack 64 (FIGS. 12 and 13) contains a releasable gripper mechanism operatively arranged in mounting 82 which straddles the slide way 28 on which the jack is located. The gripper mechanism grips the slide way 28 tightly when the piston rods 68 are actuated to move forward out of cylinders 66 thereby causing pressure to be applied to the mat 12. After the mat 12 has been pushed forward a suitable distance determined by the extendable length of the piston rods 68, the gripper mechanism is released and hydraulic fluid is supplied under pressure to cause the cylinders 66 to move forward with the connecting rods 68 stationary. This pulls the gripping mechanism along to a new, forward location on the slide way 28. The wood planks 36 frictionally adhere to the mat bottom and move in unison with it. However, the bottom of the planks slide readily on the slide ways 28 because of the lubricating effect of grease 34. The gripper mechanism then is actuated again to grip the slide way 28 following which the piston rods are caused to move forward and apply pressure to the mat 12 to cause it to slide forward. This description of the operation of jack 64 applies equally to jack 66 since they are identical.

Figure 14:
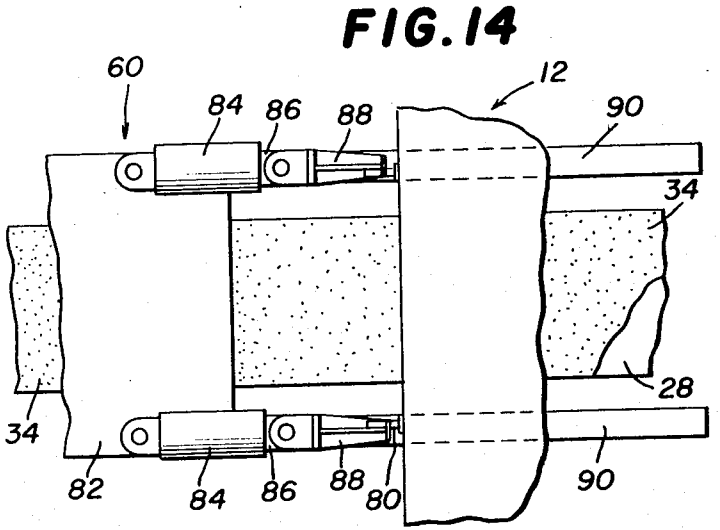
FIG. 14 is a plan view showing the arrangement of the smaller gripper-pusher jacks used to apply pressure to the mat stern.
Figure 15:
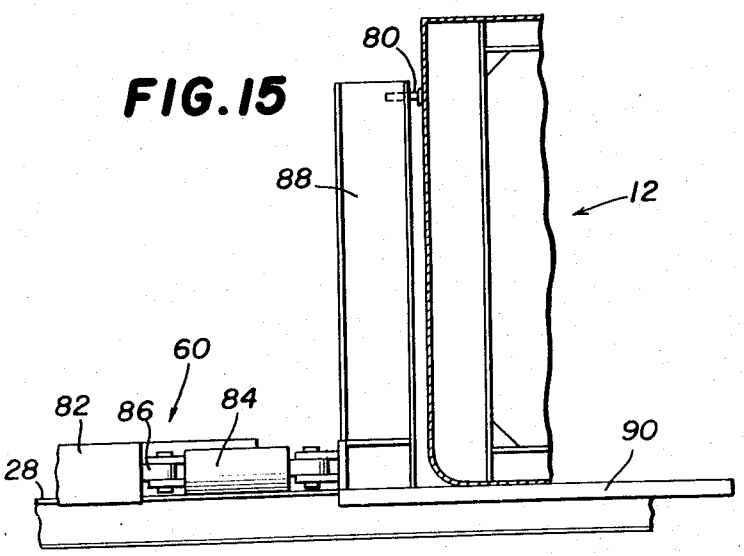
FIG. 15 is an elevational view of the arrangement shown in FIG. 14.

The gripper jack 60 shown in FIGS. 14 and 15 has a pair of cylinders 84 pivotally connected to slide way gripper mechanism mounting 82. A piston rod 86 extends forward from each cylinder 84 into pivotal connection with the bottom portion of a vertical transom member 88. A leg 90, joined to the bottom of each transom 88, extends beneath and in contact with the bottom of mat 12 to which it is securely welded. A pad 80 is placed between the top of each transom 88 and the adjacent vertical wall of mat 12. The operation of the gripper jack 60 is identical to the larger jack 64. Since jack 62 is identical to jack 60 they operate in the same way.

Hoist 100 and sheaves 102 and 104 are mounted on dock 20 (FIG. 1). Wire rope lines 106 and 108 are run from the hoist through the sheaves and held ready to be connected to the stern of mat 12 at bollards 110 and 112 after the drilling rig 10 is launched. Similarly, a wire rope line 114 is connected to the bow of the drilling rig and run straight ahead to another hoist (not shown) anchored at a suitable place so as to help control the rig as it moves away from the dock after it is fully supported on the launch cans.

Figure 3:
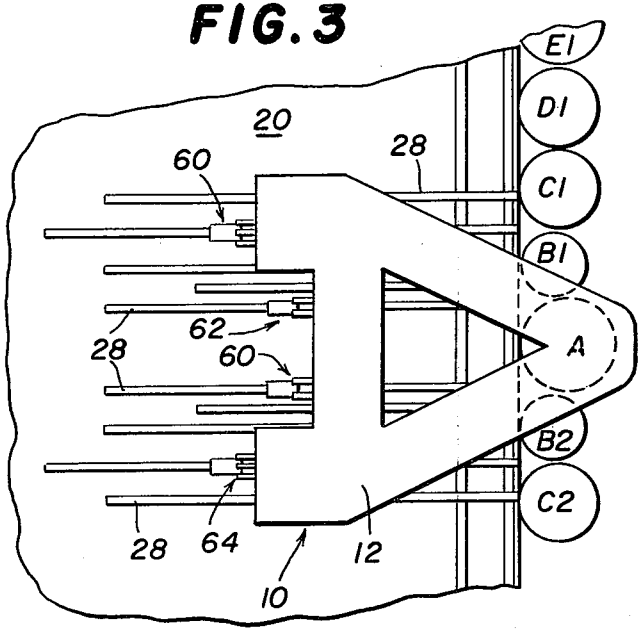
FIG. 3 is a plan view of the mat portion of the drilling rig after it has been pushed out a sufficient distance past the dock edge so that the first launch can could be positioned beneath the rig in load bearing arrangement.
Figure 2:
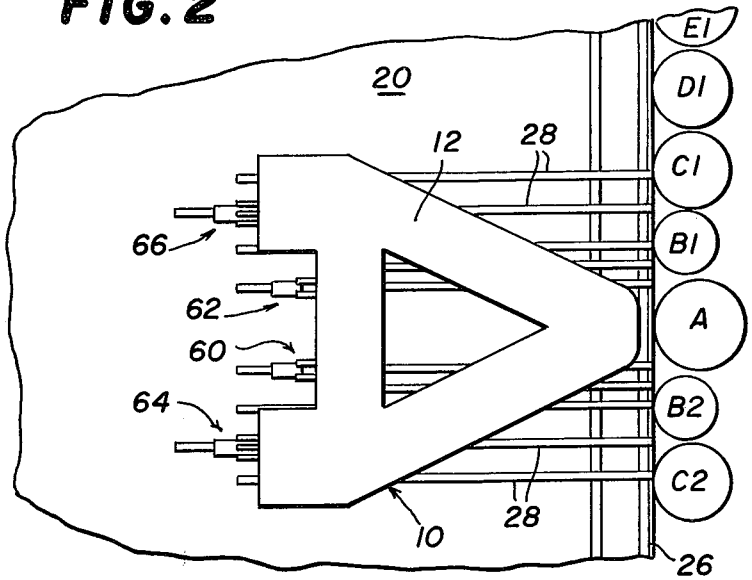
FIG. 2 is a plan view of the mat portion of the rig in prelaunch position at the dock on supporting slide ways.
Figure 3A:
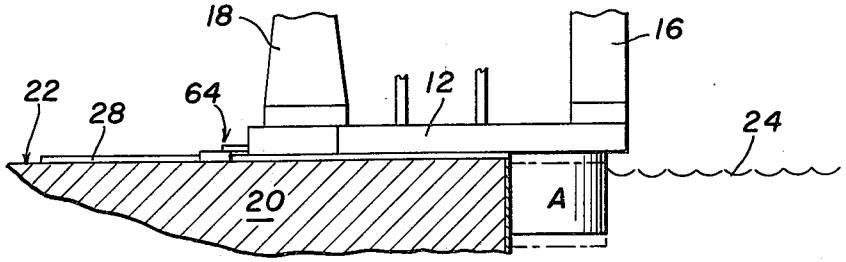
FIG. 3A is a partial side elevational view of the drilling rig in the same position shown in FIG. 3.
Figure 2A:
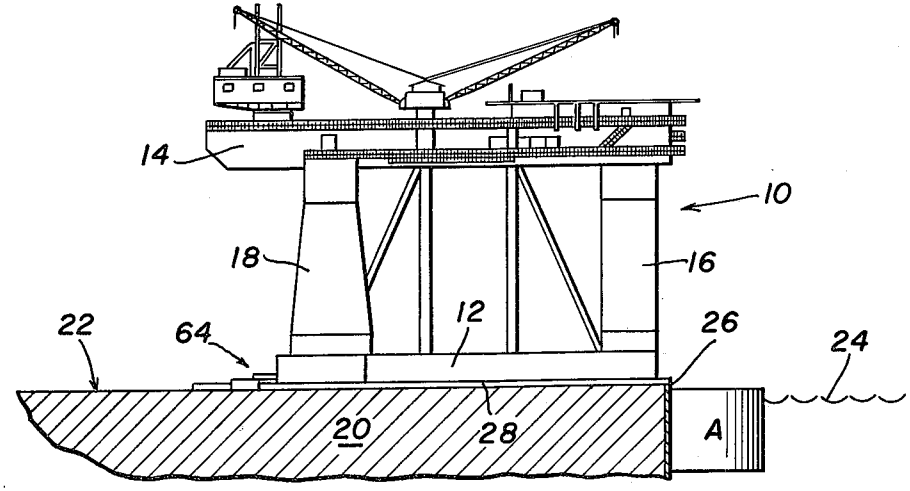
FIG. 2A is a side elevational view of the drilling rig in the same position as shown in FIG. 2.
Figure 4:
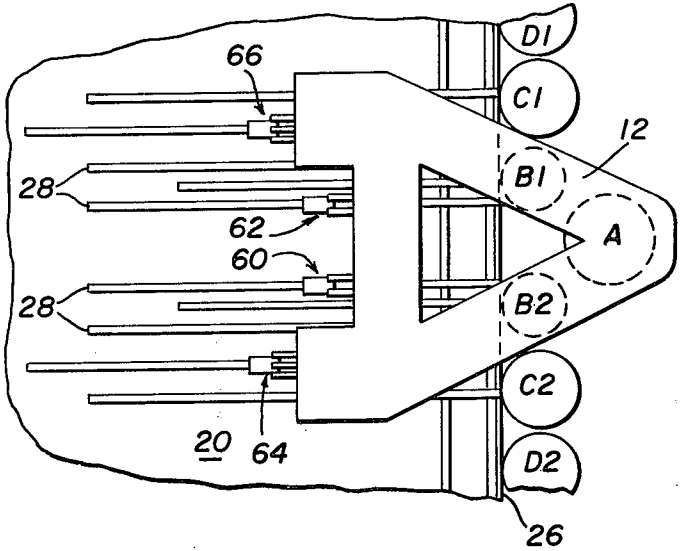
FIG. 4 is a plan view of the mat portion of the drilling rig after it has been pushed forward more, from the position shown in FIGS. 3 and 3A, and two additional launch cans have been placed beneath the rig in load bearing arrangement.
Figure 4A:
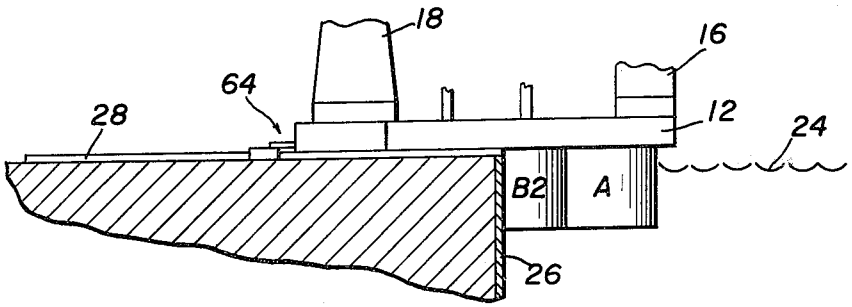
FIG. 4A is a partial side elevational view of the drilling rig in the same position shown in FIG. 4.

After all equipment is in place as shown in FIGS. 1, 2 and 2A and preparations for launching the rig are completed, launching is started by actuating gripper jacks 60, 62, 64 and 66. The jacks are used to push the bow over the dock edge 26 until it extends far enough to allow placement of launch can A. All hard wood planks 36 cantilevered past the dock edge 26 are then cut off, such as with a chain saw. This operation is repeated to keep the planks from interfering with subsequent launch can positioning beneath mat 12. Launch can A is then deballasted by pumping air through conduit 52 into the can until it rises into load supporting contact with the bottom of mat 12 (FIGS. 3 and 3A). The jacks are then actuated again to push the drilling rig a sufficient distance past dock 26 to allow placement of launch cans B1 and B2 under mat 12 (FIGS. 4 and 4A). Then the launch cans B1 and B2 are positioned and deballasted by feeding pressurized air into them through conduit 52. At the same time, the pressure in launch can A is controlled by adding or removing air to properly balance the loads applied to the cans and the dock; this can also be done continuously as the drilling rig 10 is pushed forward to be supported by launch cans B1 and B2.

Figure 5:
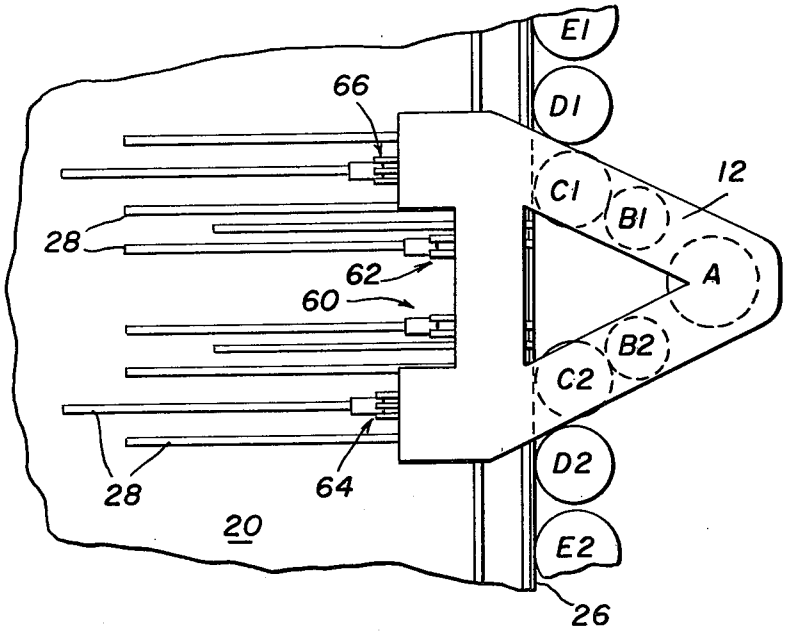
FIG. 5 is a plan view of the mat portion of the drilling rig after it has been pushed forward a further distance, from the position shown in FIGS. 4 and 4A, and two additional launch cans have been placed beneath the rig in load bearing arrangement.
Figure 5A:
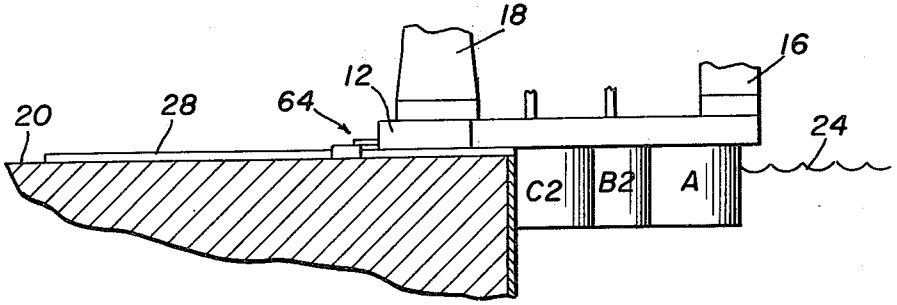
FIG. 5A is a side elevational view of the drilling rig in the same position shown in FIG. 5.

In the next step of the launching, the drilling rig 10 is pushed forward until there is room to position launch cans C1 and C2 beneath the mat (FIGS. 5 and 5A). After removal of the extended portions of planks 36, the cans are moved into place. Then pressurized air is fed to the cans to deballast them and raise the can tops into load supporting contact with the mat 12 bottom. The pressures in launch cans A, B1 and B2 are controlled to properly distribute the load.

Figure 6:
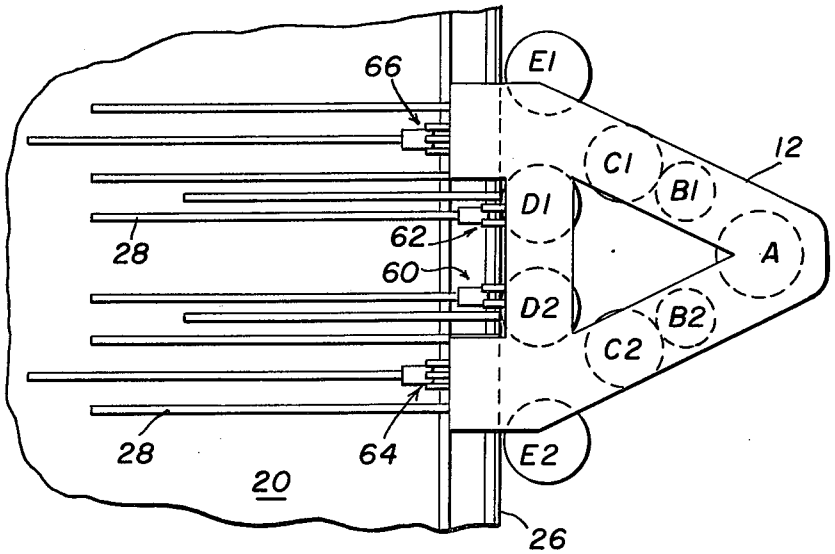
FIG. 6 is a plan view of the mat portion of the drilling rig after it has been pushed forward further, from the position shown in FIGS. 5 and 5A, and two more launch cans have been placed beneath the rig in load bearing arrangement.
Figure 6A:
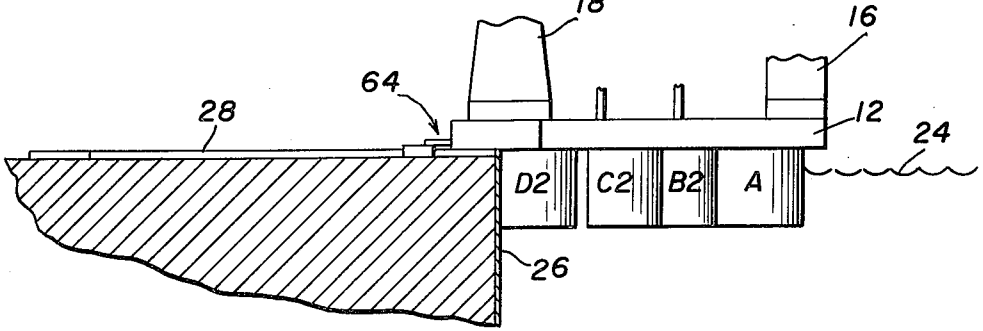
FIG. 6A is a side elevational view of the drilling rig in the same position shown in FIG. 6.

The described procedure is repeated until there is room beneath the mat to put launch cans D1 and D2 in position (FIGS. 6 and 6A). The launch cans D1 and D2 are deballasted by supplying air through conduit 52 to their interior space. Again, the pressures in launch cans A, B1, B2, C1 and C2 are controlled to maintain proper distribution of the load.

The two gripper jacks 60 and 62 and the attachments 88 and 90 are then removed.

Figure 7:
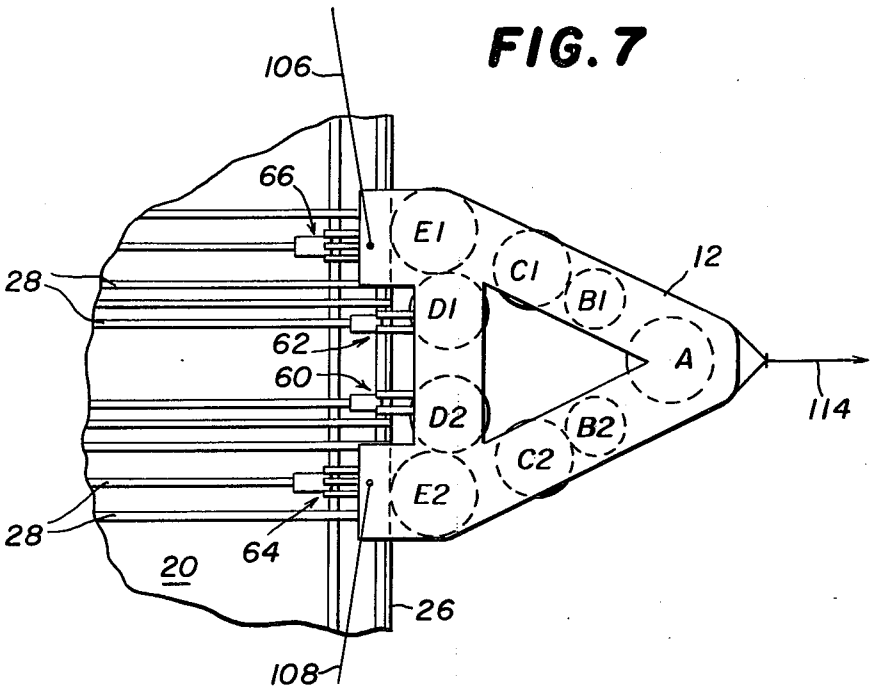
FIG. 7 is a plan view of the mat portion of the drilling rig after it has been pushed forward still further, from the position shown in FIGS. 6 and 6A, and two additional launch cans have been placed beneath the rig in load bearing arrangement.
Figure 7A:
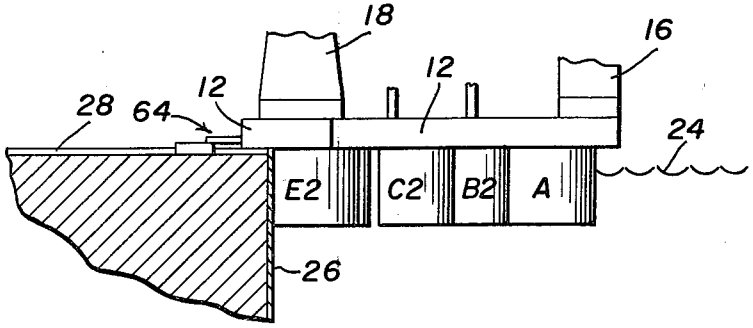
FIG. 7A is a side elevational view of the drilling rig in the same position shown in FIG. 7.

The drilling rig is then pushed forward again to make room for launch cans E1 and E2 beneath mat 12 (FIGS. 7 and 7A). These cans are subsequently deballasted, by feeding pressurized air into them through conduit 52, until they are in load supporting position beneath mat 12. The pressures in launch cans A, B1, B2, C1, C2, D1, and D2 are controlled as may be needed during this step to maintain proper load distribution. Care is taken at this stage to only partially deballast launch cans E1 and E2. This is done so that the rig will not move away from the dock.

Hoist lines 106 and 108 (FIG. 1) are then connected to bollards 110 and 112 on the mat stern to guide and control the drilling rig as it moves away from the dock to deeper water. Line 114 also is used for the same purpose. Then the jacks 64 and 66 are disconnected from the drilling rig. Also, transoms 76 and 78 and legs 72 and 78 are removed from mat 12.

Figures 8, 9, 10:
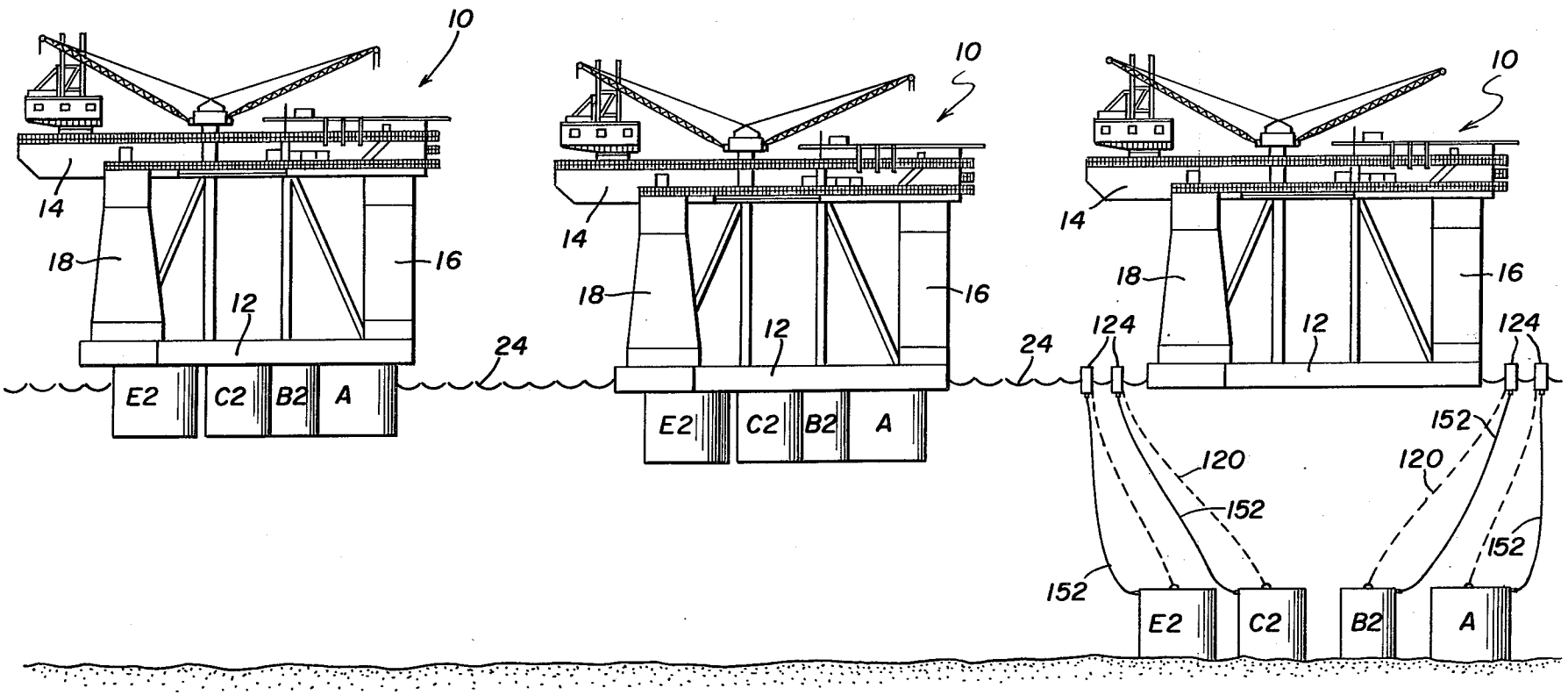
FIG. 8 is a side elevational view of the drilling rig moved away from the dock but floating on the launch cans with the mat above water.
FIG. 9 is a side elevational view of the drilling rig floating on the water with the launch cans still positioned beneath the drilling rig mat due to their minimal positive buoyancy.
FIG. 10 is a side elevational view of the drilling rig floating on water as shown in FIG. 9 and with the launch cans sunk to the sea floor but with an air line and retrieval line running from the cans to buoys.

With preparations complete, launch cans E1 and E2 are deballasted until the rig floats free of the dock. Then the drilling rig 10 is moved a short distance away from the dock to deeper water (FIG. 8). It is held in place with the hoist lines 106, 108 and 114 while launch cans B1, B2, C1, C2, D1 and D2 are ballasted by removing air from them through conduit 54, 56. When the entire bottom of mat 12 touches the water, launch cans A, E1 and E2 are deballasted by removing air through conduit 54, 56. Some air is left in cans E1 and E2 to keep the rig level. Without this support the drilling rig stern would be lower than the bow because the stern is inherently heavier than the bow until consumable goods is placed on board toward the bow. At this stage, except for launch cans E1 and E2, air remains only in ring or skirt 50 of each launch can 40 and, because it thus has a minimal positive buoyancy, it remains beneath mat 12 (FIG. 9). Except for launch cans E1 and E2 air is then removed from the inside of skirt 50 of the launch cans through conduit 52, while air is removed from outside of skirt 50 of launch cans E1 and E2 to maintain the rig level. As air is vented from inside skirt 50 the launch cans sink to the bottom of the launching basin because they now have negative buoyancy. Finally, all of the air is removed from launch cans E1 and E2 and they too fall away from the rig. The launched drilling rig is then moved back to the dock by hoist-connected lines 106 and 108.

A retrieval line 120 connects each launch can to a buoy 124 so its location remains known (FIG. 10). An air line 152 is also run from each buoy to the conduit 52 of each sunken launch can so that air can be forced into the can later to refloat it for recovery and reuse.

The launching procedure just described can be reversed to return the drilling rig 10 to the dock 20 from its launched floating state when substantial repairs or refurbishing are required. All that is necessary is to put the launch cans 40 in ballasted position beneath the floating drilling rig, deballast the cans by feeding pressurized air into them by conduit 52 until the cans support the drilling rig at the height of dock 26, connect the gripper jacks, ballast and remove the cans in a sequence the reverse of that used in the launch, actuate the jacks and pull the rig back onto the slide ways 28 on the dock 20.

For a drilling rig of the type illustrated in the drawings weighing about 5000 tons, the launch cans have from 36 to 48 foot diameters and a 26 foot height. They are desirably made of thin steel plate. Since they are subjected to no substantial external differential pressure, they need not be reinforced to withstand high pressures as would be required if the cans were inverted, the open end were up, the can bottom were below the sea surface, and the cans were floating substantially empty of water. By using launch cans as described according to the invention, they can be readily fabricated of lighter weight with less metal used and with low capital investment. Since the cans are reusable, their capital investment can be spread over a number of jobs.

The foregoing detailed description has been given for clearness of understanding only, and no unnecessary limitations should be understood therefrom, as modifications will be obvious to those skilled in the art.

What is claimed is:

1. A method of launching a large floatable object over a dock edge from a dock surface higher than an adjacent water surface comprising:

positioning the large floatable object on substantially horizontal supporting ways on the dock surface;

moving the floatable object along the ways until an end portion thereof extends past the dock edge and above the water;

moving at least one floating launch can having a closed top surface, a vertical wall attached to the top surrounding a space and a bottom open to the water, beneath that part of the floatable object extending past the dock edge and above the water;

pumping a gas into the launch can to increase its buoyancy and place the can top in load supporting arrangement of the bottom of the floatable object;

moving the floatable object further along the ways so as to extend more of the floatable object past the dock edge and above the water;

moving one or more additional launch cans of the described type beneath that part of the floatable object extending unsupported past the dock edge and above the water, and then pumping a gas into the launch cans to increase their buoyancy so as to place the cans in load supporting arrangement of the bottom of the floatable object;

repeating the described steps of moving the floatable object further along the ways so as to extend more of it past the dock edge and over the water, positioning additional launch cans of the described type beneath the floatable object, and pumping gas in the cans to increase their buoyancy and place the launch cans in load supporting arrangement until the floatable object is off the dock and stably and entirely floating on launch cans; and removing gas from the launch cans to decrease their buoyancy at least sufficiently for the floatable object to be lowered to float in the water without support by the cans.

2. A method according to claim 1 in which the pressure in the launch cans is controlled to balance the load as the floatable object extends further and further past the dock edge and over the water.

3. A method according to claim 1 in which the bottom of the floatable object to be launched is approximately flat and the tops of the launch cans are approximately flat.

4. A method according to claim 1 in which each launch can contains buoyancy chamber means which stabilizes the can in floating position with the top above water when no load is added to the can.

5. A method according to claim 4 in which the buoyancy chamber means includes a plurality of radially equally spaced apart constant volume closed chambers positioned along each launch can wall.

6. A method according to claim 4 in which the buoyancy chamber means includes a vertical cylindrical skirt open at the bottom and attached at the top to the lower surface of the launch can top thereby defining a space in which gas can be contained, means to remove gas from the space to lower the can in the water and means to supply gas to the space to raise the can in the water.

7. A method of positioning a large floating object having a bottom on a dock having a surface higher than the water level adjacent the dock comprising:

positioning a plurality of launch cans beneath the bottom of the floating object;

said launch cans having a closed top surface, a vertical wall attached to the top surrounding a space and a bottom open to the water;

pumping a gas into the launch cans to increase their buoyancy and place the can tops in load supporting arrangement of the bottom of the floatable object and continuing to pump gas into the launch cans until the bottom of the floating object is supported by the launch cans at or slightly above the height of the dock;

moving the large object until one end portion extends onto the dock and rests on supporting ways;

ballasting one or more launch cans adjacent the dock and removing them;

moving the large object further onto the dock by sliding it on the supporting ways;

ballasting one or more launch cans, adjacent the dock, while supporting the large object and then removing them;

moving the large object further onto the dock by sliding it on the supporting ways;

and repeating the described steps, if necessary, until the large object rests on the supporting ways on the dock unsupported by any launch cans.

8. A method according to claim 7 in which the pressure in the launch cans is controlled to balance the load as the large object extends further and further onto the dock.

9. A method according to claim 7 in which each launch can contains buoyancy chamber means which stabilizes the can in floating position with the top above water when no load is added to the can.

10. A method according to claim 4 in which the buoyancy chamber means includes a plurality of radially equally spaced apart constant volume closed chambers positioned along each launch can wall.

11. A method according to claim 9 in which the buoyancy chamber means includes a vertical cylindrical skirt open at the bottom and attached at the top to the lower surface of the launch can top thereby defining a space in which gas can be contained, means to remove gas from the space to lower the can in the water and means to supply gas to the space to raise the can in the water.

* * * * *

UNITED STATES PATENT AND TRADEMARK OFFICE

CERTIFICATE OF CORRECTION

PATENT NO. : 4,473,321

DATED : September 25, 1984

INVENTOR(S) : DAVID W. CULVER ET AL

It is certified that error appears in the above-identified patent and that said Letters Patent is hereby corrected as shown below:

On the title page:

After the end of the Abstract, insert --By reversing the operation a large floating object can be delaunched and positioned on a dock having a surface higher than the water level.--; column 4, line 19, delete "cl"; claim 10, line 1, change "4" to --9--.

Signed and Sealed this

Second Day of April 1985

[SEAL]

*Attest:*

DONALD J. QUIGG

*Attesting Officer*

*Acting Commissioner of Patents and Trademarks*